US012371224B2

(12) United States Patent
Bonfoey et al.

(10) Patent No.: US 12,371,224 B2
(45) Date of Patent: Jul. 29, 2025

(54) RESEALABLE CAN END WITH STAY ON TAB

(71) Applicant: BALL CORPORATION, Westminster, CO (US)

(72) Inventors: David J. Bonfoey, Broomfield, CO (US); Charles Carson, Westminster, CO (US); John Siles, Westminster, CO (US)

(73) Assignee: BALL COPORATION, Westminster, CO (US)

( * ) Notice: Subject to any disclaimer, the term of this patent is extended or adjusted under 35 U.S.C. 154(b) by 65 days.

(21) Appl. No.: 17/774,581

(22) PCT Filed: Nov. 6, 2020

(86) PCT No.: PCT/US2020/059361
§ 371 (c)(1),
(2) Date: May 5, 2022

(87) PCT Pub. No.: WO2021/092344
PCT Pub. Date: May 14, 2021

(65) Prior Publication Data

US 2022/0396393 A1 Dec. 15, 2022

Related U.S. Application Data

(60) Provisional application No. 62/932,633, filed on Nov. 8, 2019.

(51) Int. Cl.
*B65D 43/18* (2006.01)
*B65D 17/28* (2006.01)
*B65D 17/50* (2006.01)

(52) U.S. Cl.
CPC ..... *B65D 17/4014* (2018.01); *B65D 17/502* (2013.01); *B65D 2517/0014* (2013.01);
(Continued)

(58) Field of Classification Search
CPC .... B65D 2517/5048; B65D 2517/5043; B65D 2517/5051; B65D 2517/5054;
(Continued)

(56) References Cited

U.S. PATENT DOCUMENTS 1,153,379 A * 9/1915 Frankenberg ..... B65D 47/265 222/545
3,208,627 A * 9/1965 Lipske ..... B65D 55/06 220/276

(Continued)

FOREIGN PATENT DOCUMENTS

CH 702587 A1 * 7/2011 ..... B21D 51/383
CH 705595 A1 * 4/2013 ..... B21D 51/443

(Continued)

OTHER PUBLICATIONS

FR.2742417.translation.pdf (Year: 1995).*

(Continued)

*Primary Examiner* — Allan D Stevens
(74) *Attorney, Agent, or Firm* — Greer, Burns & Crain, Ltd.

(57) ABSTRACT

A reclosable beverage can end (10) has a circumferential curl (14) centered about a center longitudinal axis (50). A circumferential wall (15) extends downwardly from the curl (14) and inwardly towards the longitudinal axis (50). A center panel (12) is produced from a metallic material and centered about the longitudinal axis (50). The center panel (12) has a public side (34) and an opposing product side (35). A tab (26) is mounted to the public side (34) of the center panel (12). A pour opening (20) is formed by an aperture in the center panel (12) and sealed by the tab (26). The pour opening (20) is at least partially defined by a pour opening curl (22) of the metallic material of the center panel (12).

20 Claims, 15 Drawing Sheets

(52) U.S. Cl.
CPC ..... *B65D 2517/0034* (2013.01); *B65D 2517/5054* (2013.01); *B65D 2517/5056* (2013.01); *B65D 2517/5083* (2013.01)

(58) Field of Classification Search
CPC .... B65D 2517/0038; B65D 2517/0046; B65D 2517/0031; B65D 2517/0032; B65D 2517/0034; B65D 17/4014; B65D 43/18
See application file for complete search history.

(56) References Cited

U.S. PATENT DOCUMENTS

| | | | | | |
|---|---|---|---|---|---|
| 4,363,419 | A * | 12/1982 | Walz, Sr. | B65D 17/4012 | 220/269 |
| 4,433,792 | A * | 2/1984 | Mandel | B65D 17/4014 | 220/269 |
| 4,463,866 | A * | 8/1984 | Mandel | B65D 17/4014 | 220/269 |
| 4,580,692 | A * | 4/1986 | La Barge | B65D 41/18 | 220/240 |
| 4,678,096 | A * | 7/1987 | LaBarge | B65D 47/0876 | 220/273 |
| 4,681,238 | A | 7/1987 | Sanchez | | |
| 4,880,137 | A | 11/1989 | Wells | | |
| 5,285,924 | A * | 2/1994 | Morris | B65D 17/4014 | 220/729 |
| 5,725,120 | A * | 3/1998 | Ramsey | B65D 17/502 | 220/276 |
| 6,098,830 | A | 8/2000 | Jamieson | | |
| 6,626,314 | B1 * | 9/2003 | McHenry | B65D 47/265 | 220/255 |
| 6,763,963 | B1 * | 7/2004 | Martin | B65D 17/4014 | 220/254.1 |
| 7,198,168 | B2 | 4/2007 | Mizuma | | |
| 7,500,577 | B2 | 3/2009 | Wichelhaus | | |
| 8,215,513 | B1 * | 7/2012 | Grissom | B65D 17/401 | 220/268 |
| 8,556,104 | B2 | 10/2013 | Heigl | | |
| 8,651,318 | B2 | 2/2014 | Brandtner | | |
| 8,770,425 | B2 | 7/2014 | Schley et al. | | |
| 2003/0000952 | A1 | 1/2003 | Dyren | | |
| 2003/0062370 | A1 * | 4/2003 | Ball | B65D 17/502 | 220/359.4 |
| 2004/0076721 | A1 * | 4/2004 | Rosenfeld | B65D 53/08 | 426/87 |
| 2005/0051553 | A1 * | 3/2005 | Li | B65D 17/4014 | 220/730 |
| 2006/0163254 | A1 | 7/2006 | Wichelhaus | | |
| 2007/0138178 | A1 | 6/2007 | Erickson | | |
| 2009/0173737 | A1 * | 7/2009 | Ramsey | B21D 51/443 | 220/361 |
| 2011/0168709 | A1 * | 7/2011 | Wells | B65D 17/4014 | 220/272 |
| 2012/0118889 | A1 * | 5/2012 | Dunwoody | B21D 51/44 | 220/254.1 |
| 2013/0087563 | A1 | 4/2013 | Brandtner | | |
| 2014/0263320 | A1 | 9/2014 | Forrest et al. | | |
| 2015/0274355 | A1 * | 10/2015 | Grissom | B65D 17/404 | 220/268 |
| 2016/0023802 | A1 * | 1/2016 | Brandtner | B21D 51/383 | 220/258.5 |
| 2017/0129644 | A1 | 5/2017 | Jobges | | |
| 2018/0141702 | A1 | 5/2018 | Afshin | | |
| 2019/0283930 | A1 | 9/2019 | Schuver | | |
| 2020/0346831 | A1 * | 11/2020 | Kadowaki | B32B 27/32 | |
| 2020/0378144 | A1 * | 12/2020 | Belanger | B65D 90/024 | |
| 2020/0407109 | A1 | 12/2020 | Vinger | | |

FOREIGN PATENT DOCUMENTS

| | | | | |
|---|---|---|---|---|
| DE | 19912880 | A1 * | 1/2000 | B65D 17/166 |
| DE | 202015007283 | U1 | 1/2016 | |
| EP | 2272602 | A2 * | 1/2011 | B21D 51/443 |
| EP | 3248897 | A1 | 11/2017 | |
| FR | 2742417 | A1 * | 6/1997 | B65D 17/166 |
| FR | 2913670 | A1 | 9/2008 | |
| FR | 3056562 | A1 | 3/2018 | |
| IT | UB20160521 | A1 | 7/2017 | |
| KR | 20110058992 | A | 6/2011 | |
| KR | 20110130121 | A | 12/2011 | |
| KR | 20170050594 | A | 5/2017 | |
| NL | 9301501 | A * | 3/1995 | B65D 17/166 |
| WO | 9722531 | A1 | 6/1997 | |

OTHER PUBLICATIONS

International Search Report; priority document.
Patent Pro Search Report dated May 26, 2021; 4 pages.
International Search Report for International Application No. PCT/US2021/037636 dated Sep. 28, 2021; 3 pages.

* cited by examiner

RESEALABLE CAN END WITH STAY ON TAB

CROSS-REFERENCE TO RELATED APPLICATIONS

This Application is a United States National Stage Application under 35 U.S.C. Section 371 of International Patent Application No. PCT/US2020/059361 filed on Nov. 6, 2020, which is hereby incorporated by reference as if fully set forth herein. This Application also claims priority to and the benefit of U.S. Provisional Application No. 62/932,633, filed on Nov. 8, 2019, which is also hereby incorporated by reference as if fully set forth herein.

FEDERALLY SPONSORED RESEARCH OR DEVELOPMENT

N/A

TECHNICAL FIELD

The invention relates generally to stay-on tab ecology beverage containers and, more specifically, to resealable can ends for such beverage containers.

BACKGROUND OF THE INVENTION

Beverage container designers have developed many proposals for producing reclosable two-piece aluminum beverage containers having stay-on tab (SOT) ecology can ends (lids) wherein a portion of the contents can be saved for a later time. In the case of beverage cans, most of these inventions have required using a variation on a combination of materials, for example a displaceable polymeric insert mounted within a pour opening which provides an initially pressure resistant seal. None of these inventions have been commercially accepted on a widespread basis.

Recently, reclosable three-piece aluminum beverage containers have become popular in the energy drink market. These containers are reclosable by utilizing a lug-type closure added to the otherwise two-piece construction of the beverage container. Similarly, the beer market utilizes a two-piece aluminum beverage container with a threaded closure.

None of the current options has the universal and lightweight appeal of the SOT can end.

The present invention is provided to solve the problems discussed above and other problems, and to provide advantages and aspects not provided by prior can ends of this type. A full discussion of the features and advantages of the present invention is deferred to the following detailed description, which proceeds with reference to the accompanying drawings.

SUMMARY OF THE INVENTION

A first aspect of the present invention is directed to a reclosable beverage can end comprising:

- a circumferential curl centered about a center longitudinal axis of the can end;
- a circumferential wall extending downwardly from the curl and inwardly towards the longitudinal axis;
- a center panel comprising a public side and an opposing product side produced from a metallic material and centered about the longitudinal axis;
- a tab mounted to the public side of the center panel; and

- a pour opening formed by an aperture in the center panel and sealed by the tab, the pour opening at least partially defined by a curl of the metallic material of the center panel.

The first aspect of the invention may include one or more of the following features, alone or in any reasonable combination. The tab may be rotatably mounted to the center panel. The curl of the metallic material of the center panel may extend upwardly from the public side of the can end, and the tab comprises a curl extending downwardly towards the public side of the center panel and matingly engaged with the pour opening curl. The tab curl may be non-circumferential to allow rotation of the tab from a first position covering the pour opening to a second position wherein the pour opening is uncovered. An epoxy and/or a surface energy modifier may be located between the tab and the center panel to form a seal therebetween over the pour opening, preferably a hermetic seal. The seal may be broken by rotating the tab on the center panel. The epoxy may be a thermally cured epoxy. The epoxy may be cured by induction heating. The epoxy may be cured by UV light. The reclosable beverage can end may further comprise a thermoset polymer layer between the tab and the center panel forming a seal therebetween over the center panel. The tab may be staked to the public side of the center panel by a rivet. The rivet may be formed from the material of the center panel and integral therewith. The tab may be rotatable about the rivet. The tab may comprise a tail portion extending outwardly and upwardly from a surface of the tab and configured for engagement by a user's finger to rotate the tab. The tail may be located on a first end of the tab opposite a second end of the tab covering the pour opening. The tail may be located on an end of the tab wherein a portion of the tab covering the pour opening is also located on the end of the tab. The reclosable beverage can end may further comprise a second tail wherein the tail is located on a first end of the tab opposite a second end of the tab which covers the pour opening and wherein the second tail is located on the second end the tab. The tab may comprise a finger hole. The finger hole may be located on a first end of the tab opposite a second end of the tab covering the pour opening.

A second aspect of the invention is directed to a reclosable beverage can end comprising:

- a circumferential curl centered about a center longitudinal axis of the can end;
- a circumferential wall extending downwardly from the curl and inwardly towards the longitudinal axis;
- a center panel comprising a public side and an opposing product side produced from a metallic material and centered about the longitudinal axis;
- a rotatable tab mounted to the public side of the center panel;
- a pour opening formed by an aperture in the center panel;
- one or more layers of a sealing material and a surface energy modifier located between a surface of the tab and the center panel wherein a combination of the sealing material, the surface energy modifier, the center panel, and the tab forms a seal of the pour opening.

The second aspect of the invention may include one or more of the following features, alone or in any reasonable combination. The seal may be broken by rotating the tab on the center panel. The layer of the sealing material may have an annular shape. The layer of the sealing material may have a disk shape. The sealing material may be an epoxy. The epoxy may be a thermally cured epoxy. The epoxy may be cured by induction heating. The epoxy may be cured by UV light. The reclosable beverage can end may further comprise a thermoset polymer layer between the tab and the center panel forming the seal therebetween. The tab may be staked to the public side of the center panel by a rivet. The rivet may be formed from the material of the center panel and integral therewith. The tab may comprise a tail portion extending outwardly and upwardly from a surface of the tab and configured for engagement by a user's finger to rotate the tab. The tail may be located on a first end of the tab opposite a second end of the tab covering the pour opening. The tail may be located on an end of the tab wherein a portion of the tab covering the pour opening is also located on the end of the tab. The reclosable beverage can end may further comprise a second tail wherein the tail is located on a first end of the tab opposite a second end of the tab covering the pour opening and wherein the second tail is located on the second end the tab. The tab may comprise a finger hole. The finger hole may be located on a first end of the tab opposite a second end of the tab covering the pour opening. The pour opening may be at least partially defined by a curl of the metallic material of the center panel. The curl of the metallic material of the center panel may extend upwardly from the public side of the can end, and the tab comprises a curl extending downwardly towards the public side of the center panel and matingly engaged with the pour opening curl. The sealing material may be located between the tab curl and the curl of the metallic material of the center panel. The tab curl may be non-circumferential to allow rotation of the tab from a first position covering the pour opening to a second position wherein the pour opening is uncovered.

A third aspect of the invention is directed to a reclosable beverage can end comprising:

- a circumferential curl centered about a center longitudinal axis of the can end;
- a circumferential wall extending downwardly from the curl and inwardly towards the longitudinal axis;
- a center panel produced from a metallic material and centered about the longitudinal axis comprising a public side and an opposing product side;
- a tab mounted to the public side of the center panel;
- a pour opening formed by an aperture in the center panel;
- a peelable closure member produced from a flexible laminate and sealed to the center panel about the pour opening to form a seal over the pour opening.

The third aspect of the invention may include one or more of the following features, alone or in any reasonable combination. The tab may be rotational along the public side of the center panel to selectively reclose the pour opening. The seal may be broken by peelably removing the peelable closure member from the center panel. The reclosable beverage can end may further comprise a layer of a sealing material between the peelable closure member and the center panel. The layer of sealing material may have an annular shape. The sealing material may be an epoxy. The epoxy may be a thermally cured epoxy. The epoxy may be cured by induction heating. The reclosable beverage can end may further comprise a thermoset polymer layer between the peelable closure member and the center panel forming the seal therebetween. The tab may be staked to the public side of the center panel by a rivet. The rivet may be formed from the material of the center panel and integral therewith. The tab may comprise a tail portion extending radially outwardly from a surface of the tab and configured for engagement by a user's finger to rotate the tab. The tail may be located on a first end of the tab opposite a second end of the tab covering the pour opening. The tail may be located on an end of the tab wherein a portion of the tab covering the pour opening is also located on the end of the tab. The reclosable beverage can end may further comprise a second tail wherein the tail is located on a first end of the tab opposite a second end of the tab covering the pour opening and wherein the second tail is located on the second end the tab. The flexible laminate may be a metal foil.

The reclosable beverage can of any of the above embodiments may be entirely produced from aluminum Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
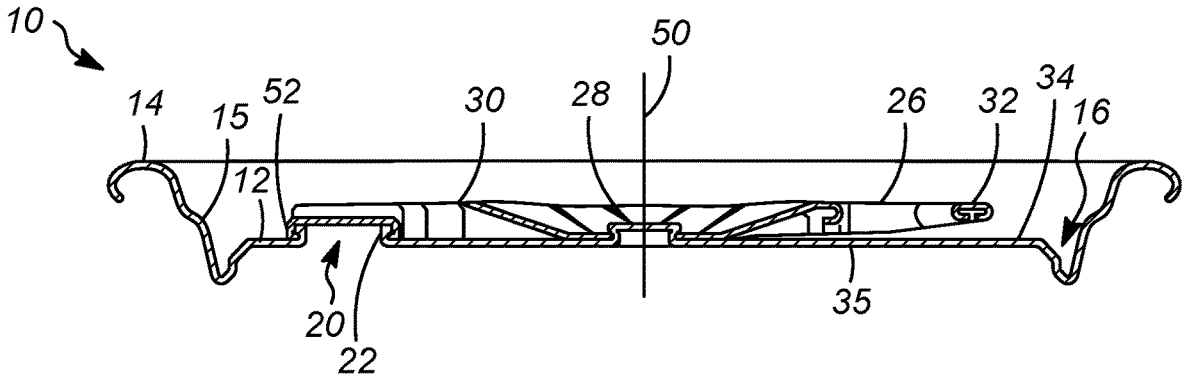
FIG. 1 is a cross-sectional view of a reclosable beverage can end of the present invention taken through I-I of FIG. 5.
Figure 2A:
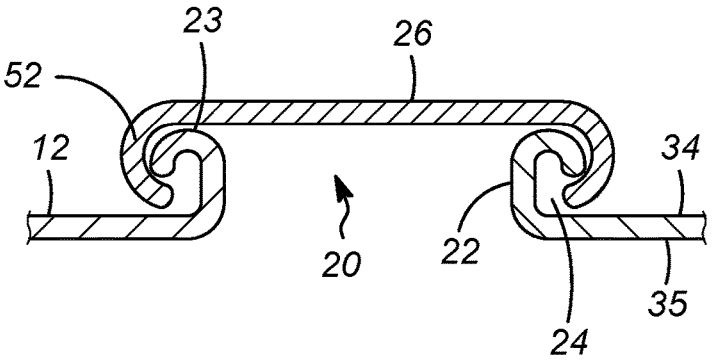
FIG. 2A is a magnified cross-sectional view of portion of FIG. 1 taken through A-A of FIG. 5 showing a sealed pour opening.
Figure 2B:
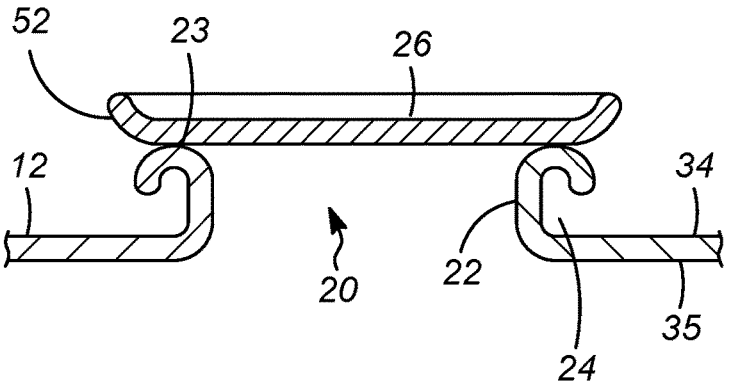
FIG. 2B is a cross-sectional view taken through B-B of FIG. 5 of the sealed pour opening taken transverse to the view shown in FIG. 2A.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a reclosable beverage can end 10 for containers (not shown) has a center panel 12 separated from a seaming curl 14 by a circumferential wall 15 extending downwardly from the seaming curl 14 to a strengthening segment 16 which is joined to the center panel 12. The container is typically a drawn and ironed metal can, usually constructed from a thin plate of aluminum or steel. Beverage can ends for such containers are also typically constructed from a cutedge of thin plate of aluminum or steel, formed into blank end, and manufactured into a finished end by a process often referred to as end conversion.

The can end 10 can be joined to a container body by the seaming curl 14 which is joined to a mating curl of the container body. The seaming curl 14 of the can end 10 is integral with the center panel 12 by the circumferential wall 15 and the strengthening segment 16, typically either a generally U-shaped countersink or a fold, which is joined to a peripheral edge of the center panel 12, defining an outer perimeter of the center panel 12, often through an additional strengthening feature such as a circumferential step or other circumferential wall. This type of means for joining the center panel 12 to a container body is presently the typical means for joining used in the industry, and the curl structure described above is formed in the process of forming the blank end from a cutedge of metal plate, prior to the end conversion process. However, other means for joining the beverage can end to a container body may be employed with the present invention.

The circumferential seaming curl 14 defines an outer perimeter of the beverage can end 10. It is generally centered about a longitudinal or vertical axis 50, typically located at a center of a rivet.

The center panel 12 has a pour opening 20 formed by an aperture in the center panel 12. The pour opening is at least partially defined by a curl 22 of the center panel 12 metallic material. The curl 22 may be circumferential about the aperture. The curl 22 is formed by a bend of the metal causing a convex lip 23 and a concave receiver 24. The term "curl" is intended to encompass any bend-like structure directing the metal of the center panel out of a plane of adjacent portions of the center panel and, preferably, capable of mating with a similarly shaped structure on the tab 26 to retain the tab in position over the aperture. The center panel may be shaped, inscribed, or contain other indicia defining a direction for tab rotation (see FIG. 6).

The center panel 12 has a public side 34 and an opposing product side 35, and a tab 26 is attached thereto, preferably attached to allow for rotation of the tab 26 along the surface of the center panel 12. The tab 26 has a generally elongated body along a diametric first axis extending through a first end of the tab 26, a central webbing and an opposing second end 30 of the tab 26. The tab 26 is staked to the center panel 12 by a rivet 28 generally through a rivet aperture through a central portion of the tab 26.

An unsealing of a sealed pour opening 20 is operated by the tab 26. A user rotates the tab 26 about the rivet 28. This breaks a seal between the tab 26 and the public side 34 of the center panel 12. To facilitate this rotation, the lift end 32 of the tab 26 may be configured with a finger hole 40 (FIG. 1) and/or one or more tail portions 42 (FIGS. 7 and 8) extending outwardly from a surface of the tab 26 and the upwardly relative to the public side 34 of the center panel 12 and configured for engagement by a user's finger to rotate the tab 26.

Rotation of the tab 26 can be facilitated by altering the geometry or size of the rivet 28 and/or altering the rivet hole in the tab 26 to provide a loose stake to the tab to the can end. This may or may not require a change in final stake tooling in a conversion press or the like, where the tab 26 is staked or attached to the can end.

The seal is formed between the public side 34 of the center panel and a lower surface of the tab 26. The tab 26 includes a curl 52 extending downwardly towards the public side 34 of the center panel 12 and matingly engages with the pour opening curl 22. As best shown in FIGS. 2A-4B, the tab curl 52 wraps along the convex lip 23 of the pour opening curl 22, which convex lip 23 is formed from the product side 35 of the can end 10. A terminal end of the tab curl 52 is received within the concave receiver 24 of the pour opening curl 22 to retain the tab 26 over the pour opening 20. The tab curl 52 may be circumferential or, as shown in FIGS. 2B-4B, non-circumferential to allow rotation of the tab 26 from a first position covering the pour opening 22 to a second position wherein the pour opening 22 is uncovered (see, e.g. FIGS. 5 and 6). The tab curl 52 may also be formed such as to help prevent over-rotation of the tab from the second position back to the first position (closed).

The tab curl may have a first tab curl portion extending downwardly and wrapping over the convex lip of the pour opening curl, the first tab curl portion having a first tab curl portion terminal end received within the concave receiver of the pour opening curl. The tab curl may further have a second tab curl portion having a second tab curl portion terminal end that is spaced upwardly from the concave receiver of the pour opening.

Figure 3A:
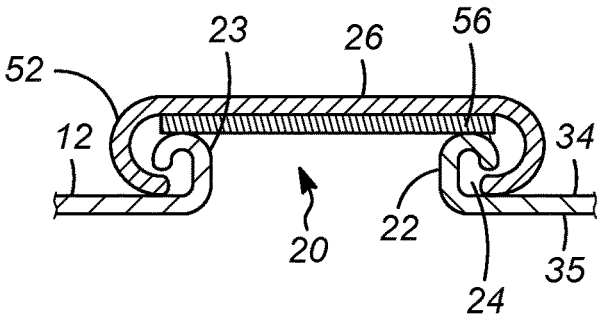
FIG. 3A is an alternative arrangement of that shown in FIG. 2A showing a sealed pour opening.
Figure 3B:
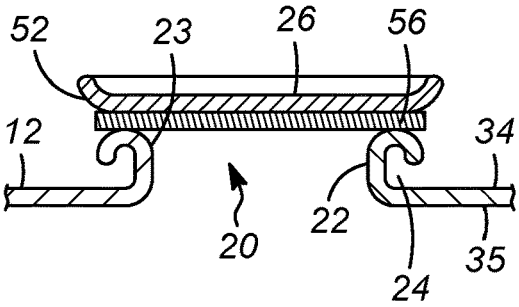
FIG. 3B is a view of the sealed pour opening taken transverse to the view shown in FIG. 3A.
Figure 4A:
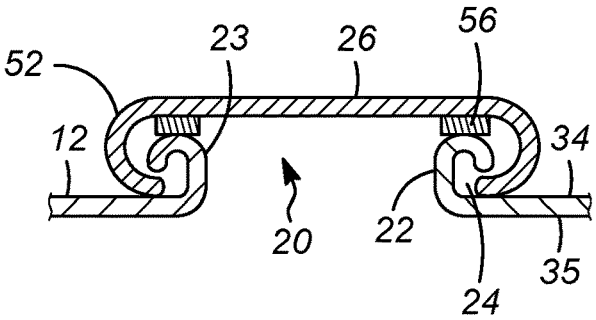
FIG. 4A is an alternative arrangement of that shown in FIG. 2A showing a sealed pour opening.
Figure 4B:
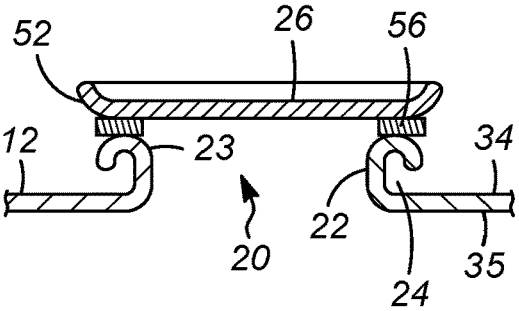
FIG. 4B is a view of the sealed pour opening taken transverse to the view shown in FIG. 4A.
Figure 9:
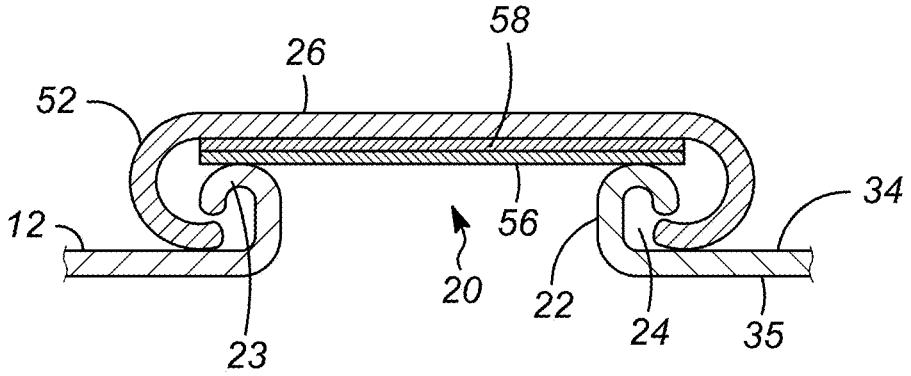
FIG. 9 is a magnified portion of a can end showing a sealed port opening with layers of sealing materials, including a surface energy modifier layer.

The seal may be further formed by layers of a sealing material 56 and/or sealing materials 58 designed to modify the surface energy of the sealing surfaces (see FIG. 9). The sealing material(s) 56,58 is/are located between the tab 26 and a surface of the center panel 12 the sealing material 58 designed to modify the surface energy of the sealing surfaces may be located along the convex lip 23 of the pour opening curl 22 such that it engages a bottom surface of the tab 26, generally including the tab curl 52. Thus, multiple layers of sealing material(s) 56,58 may be located between a surface of the tab 26 and the center panel 12 wherein a combination of the sealing material(s) 56,58, the center panel 12 and the tab 26 forms a seal of the pour opening 20. The sealing material(s) 56 may have an annular shape as shown in FIGS. 4A and 4B or be a disk shape as shown in FIGS. 3A and 3B. However, it should be understood that the sealing material(s) 56,58 can take any shape or form which achieves the function of providing the necessary sealing of the pour opening 20. The sealing material(s) 56,58 can be on the tab 26 or the can end 10 or both. Placing the sealing materials 56,58 on both surfaces permits a better seal when heat sealing or ultrasonic welding techniques are employed. The sealing material(s) 56,58 preferably form(s) a hermetic seal.

Suitable surface energy modification techniques or layers include plasma activation, a layer of a wet chemical treatment, including grafting, and a layer of thin-film coating.

Optionally, the sealing material 56 may be an epoxy, such as a thermally cured epoxy. The epoxy can be cured, for example, by induction heating or UV light. Alternatively, the sealing material 56 can be a thermoset polymer layer between the tab 26 and the center panel 12 forming the seal therebetween.

Alternatively, the sealing material 56 can a thermoplastic polymer resin of the polyester family, such as polyethylene terephthalate (PET) or a polyolefin, such as polypropylene.

The rivet 28 is surrounded by a circular coined region of the center panel 12. The coined region is a compressed portion of the center panel 12 having a localized reduced thickness relative to adjacent portions of the center panel. Rivets 28 such as this are formed from the metallic material of the center panel 12 by forming the metal upwardly parallel to the longitudinal axis 50. Thus, the rivet 28 is integral with the center panel 12. Rivets 28 are well known in the art of can end manufacture and design.

Figure 5:
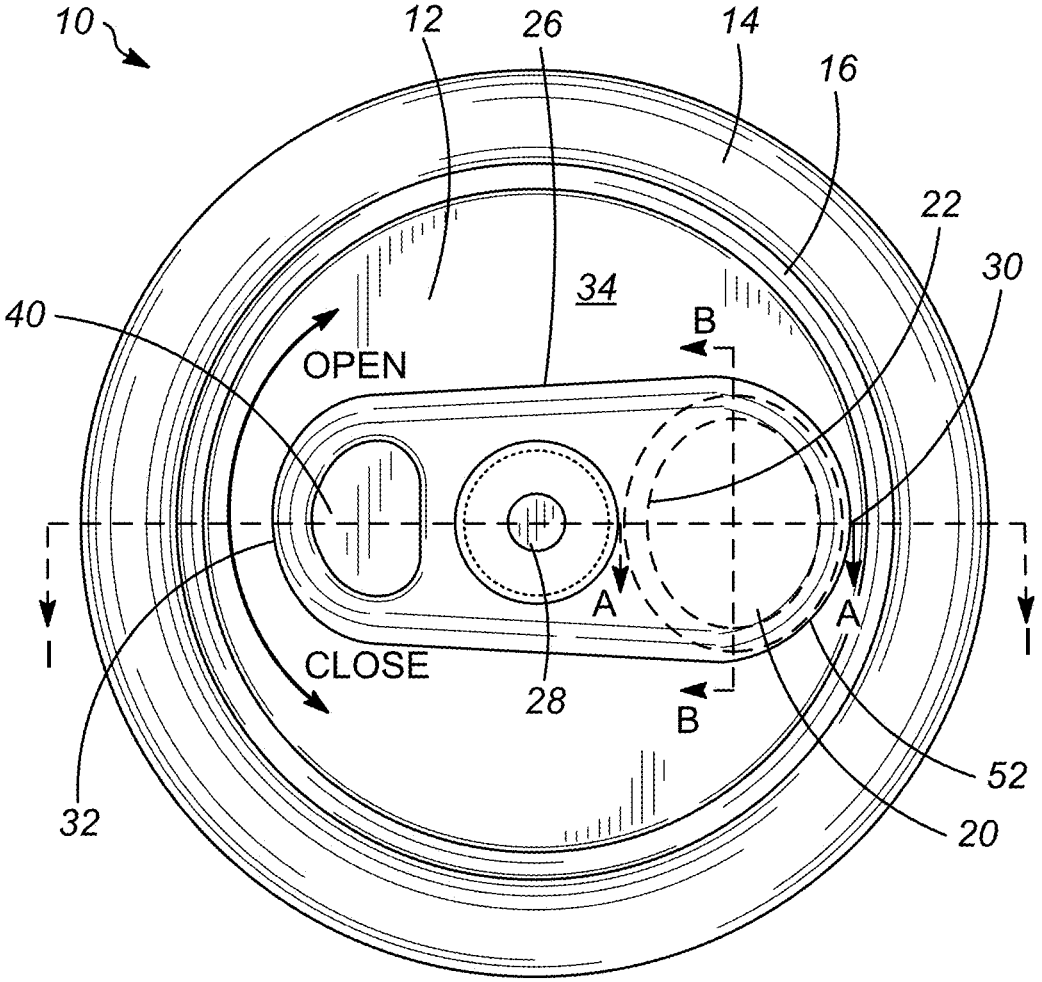
FIG. 5 is a top view of a reclosable beverage can end of the present invention showing a tab in a first position with a pour opening in a sealed condition.
Figure 6:
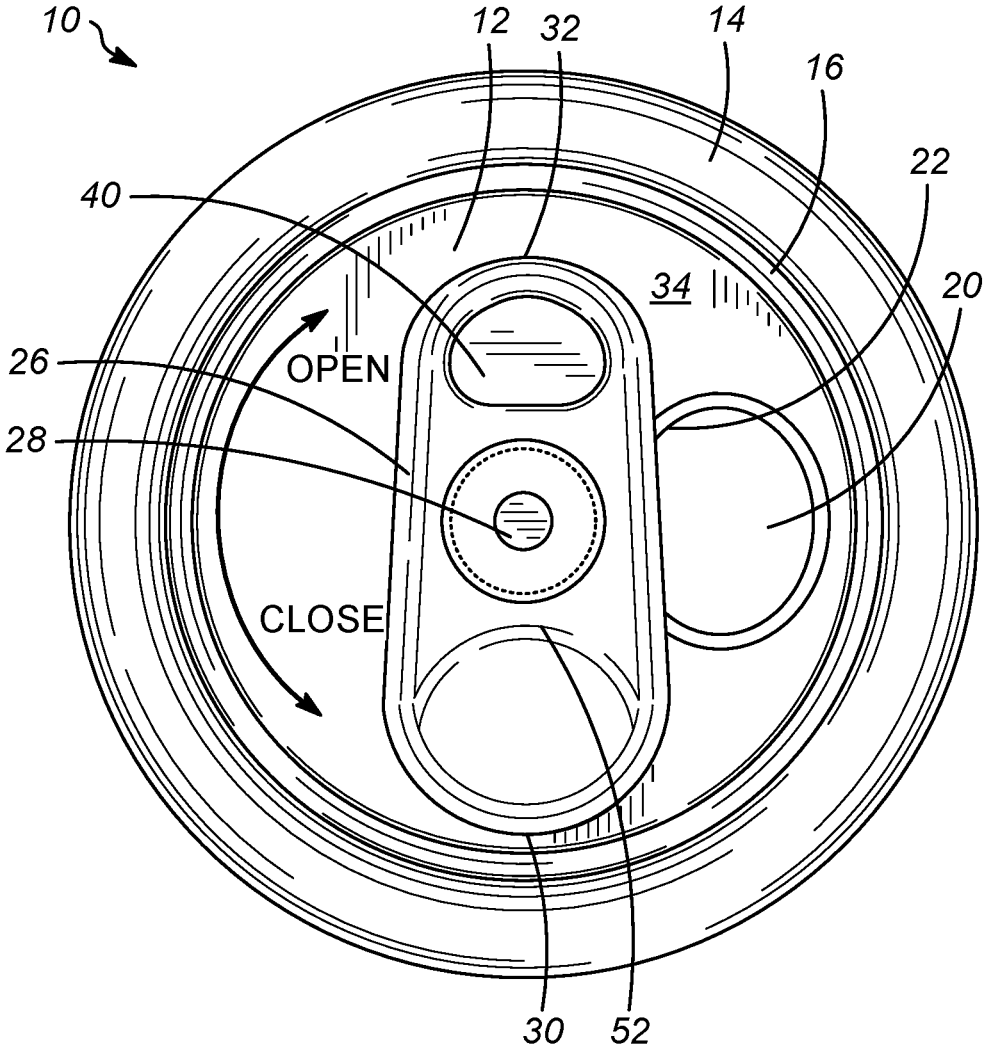
FIG. 6 is a top view of the reclosable beverage can end of FIG. 5 showing the tab rotated to a second position with a pour opening in an unsealed condition.

In operation, in a pour opening closed or initially sealed position shown in FIGS. 1 and 5, the second end 30 of the tab 26 is positioned over the pour opening 22. The tab curl 52 is mated with the pour opening curl 22 to grip the tab 26 thereto. To open or unseal the pour opening 22, the tab 26 is rotated about the rivet 28 to place the tab 26 in an open or unsealed condition as shown in FIG. 6. This breaks the seal if the can end 10 has not been previously opened. In this position, the can end 10 and the pour opening 20 is in the open condition, and any contents of the beverage container can be poured from the pour opening 20. To place the can end 10 in the closed or sealed condition, the tab 26 is rotated back to the first position such that the second end 30 of the tab 26 is again located over the pour opening 20.

Figure 7:
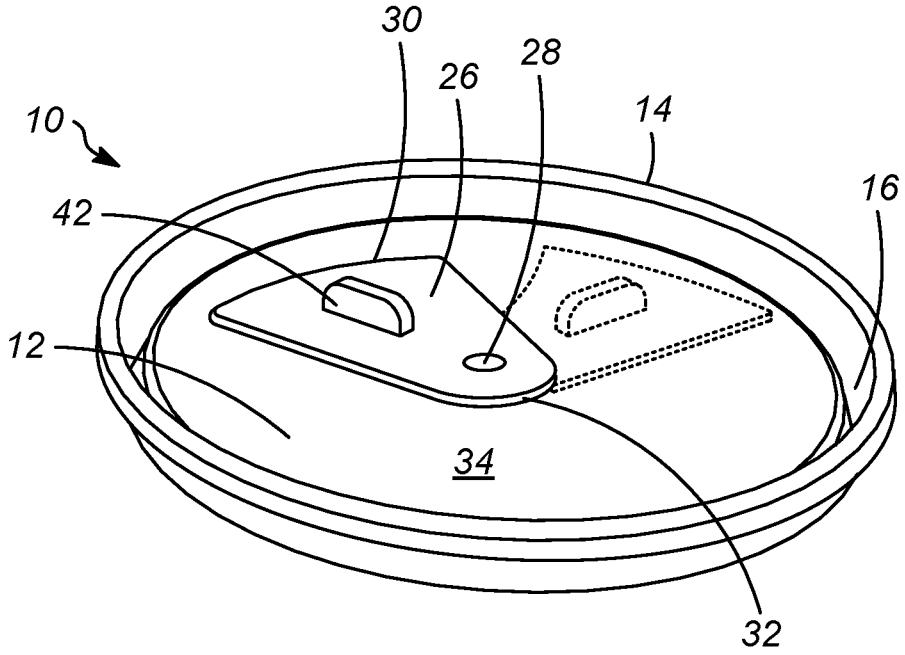
FIG. 7 is a view of an alternative embodiment of a reclosable beverage can end of the present invention.
Figure 8:
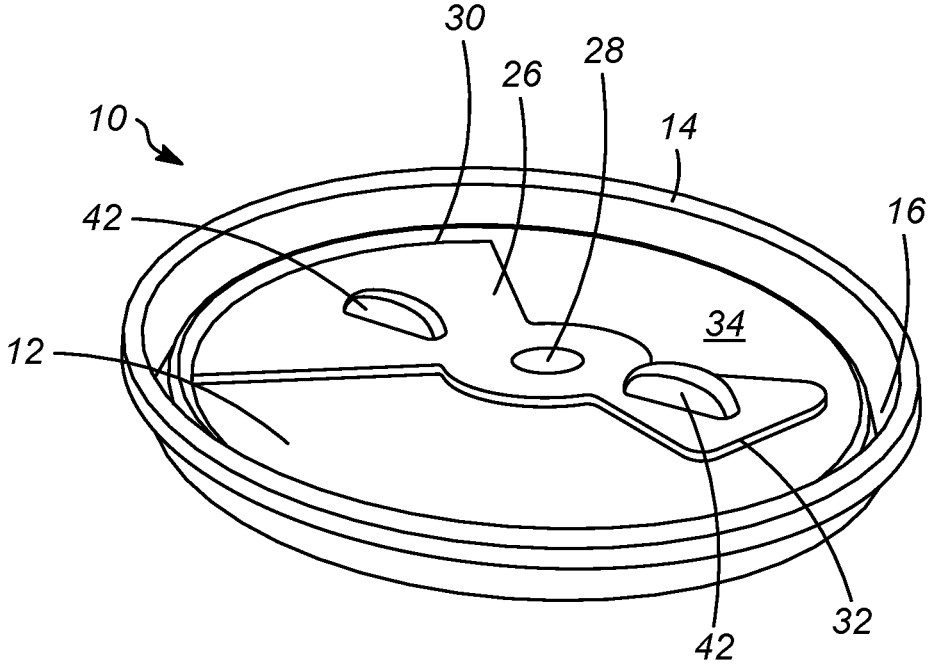
FIG. 8 is a view of an alternative embodiment of a reclosable beverage can end of the present invention.

Alternative embodiments are illustrated in FIGS. 7 and 8. In these embodiments, a bottom surface of the tab 26 may be sealed over the pour opening 20 directly. Alternatively, the tabs 26 of these embodiments can be configured with a curl, and the pour opening can also feature a curl.

In summary, referring generally to the figures, the present invention is directed to reclosable and/or resealable beverage can ends 10 for pressurized and unpressurized containers. The can ends 10 are reclosable, e.g. through rotatable stay-on-tabs. The tab 26 is fixed to the center panel 12 of the can end 10 by an integral rivet 28. As-manufactured, the seal is made, for example, by heat setting thermoplastics. The seal may be modified to ease opening through oxide layers, chemical additives, or other processes.

The structures described herein further lend themselves to resealing beverage containers. As used herein, "reclosable" is intended to encompass a mild seal that may or may not leak liquid when the beverage container is turned upside down or falls on the floor. The term "seal" generally refers to a liquid tight enclosure or seal that may or may not also be gas tight. The term "resealable" indicates a gas tight seal that will not open under normal circumstance. For example, a user can toss the resealed beverage container into a backpack, or the beverage container can roll around on the floor of a car and stay closed. The seal is gas tight so carbonation loss is minimal.

The seal is broken by rotating the stay-on-tab 26. The tab 26 may be formed with hooks, such as curls of metal that are rotated from under the similar hooks or curls on the center panel. The hooks ease manufacturing and reclosability. Thus, the invention provides metal, resealable can ends which are sealed by thermosetting plastics.

Prior practice has produced can ends which are all metal but not resealable. Container lids commonly used in the food industry utilize a thermosetting polymer to seal two metal surfaces, but there are no provisions to reseal the package.

The can ends of the present invention are novel relative to previous such can ends in the field because they combine the sealing mechanisms of peel-off closures with the resealability of rotating tabs. The present invention builds on the conventional can ends beverage containers where the can ends are sealed to the can bodies by double seaming.

It is believed that the novel components of this invention are stay-on-tabs affixed to the center panels by integral rivets; tabs are formed such that they hooks in place under curls of the center panels to ease manufacturing and reclosability. One or more tails or finger holes are provided to ease rotation. Thermoset polymer layers between the tabs and center panels 12 can be heated to create heat seals. The heat seals would be broken by rotating the tabs 26 from the sealed positions.

Figure 10A:
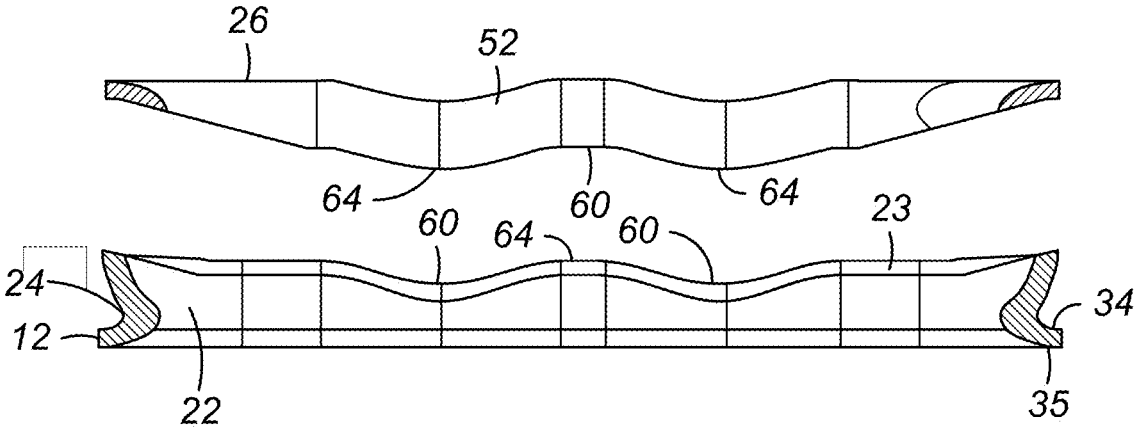
FIG. 10A is a partial exploded front view of a can end of the present invention showing a tab curl formed to prevent over-rotation of the tab along the center panel from a second position back to a first position.
Figure 10B:
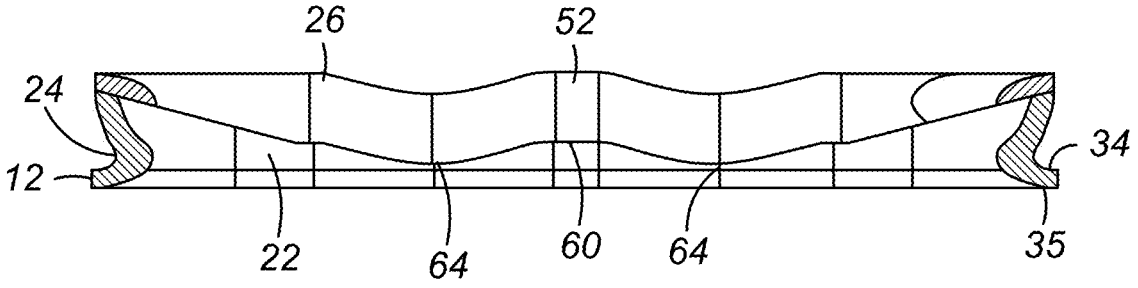
FIG. 10B is a partial front view of a can end of the present invention showing a tab curl formed to prevent over-rotation of the tab along the center panel from a second position back to a first position.
Figure 11A:
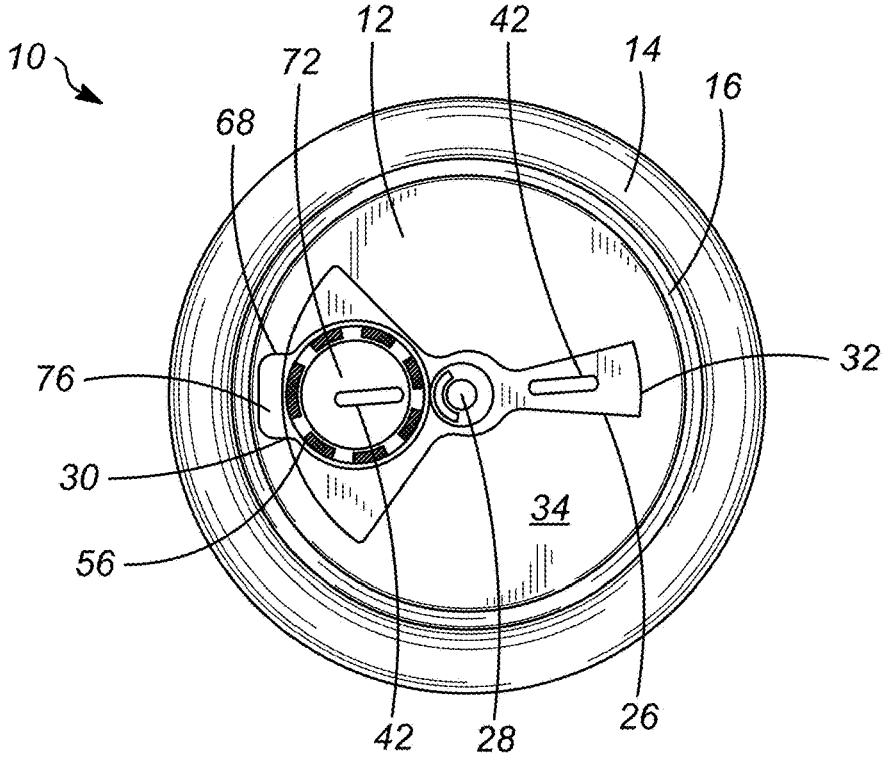
FIGS. 11A-D is top view of an alternative embodiment of the present invention having peelable closure member forming a seal over a pour opening and a rotatable tab for reclosing the pour opening.
Figure 11B:
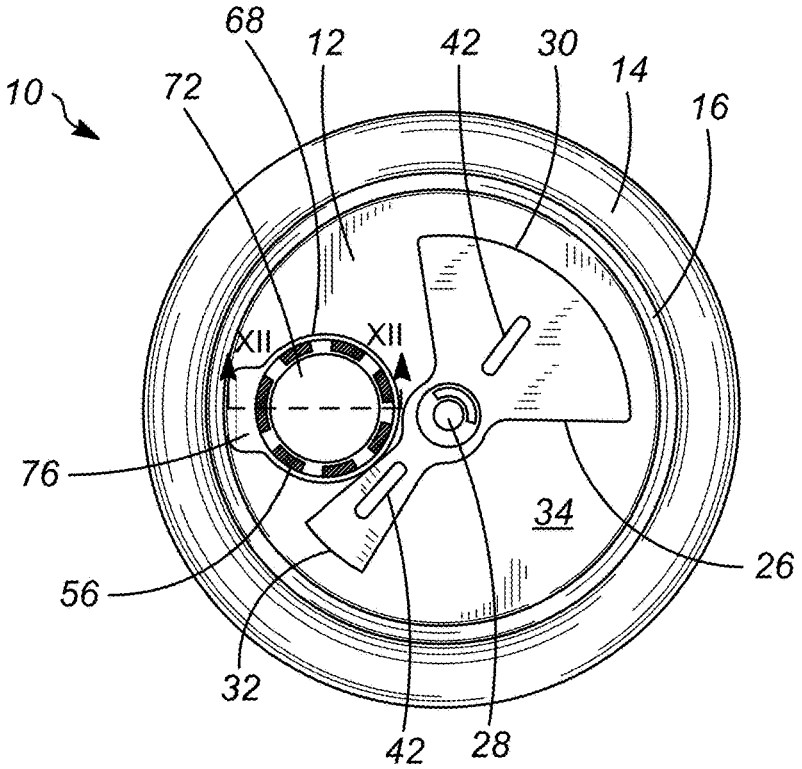
Figure 11C:
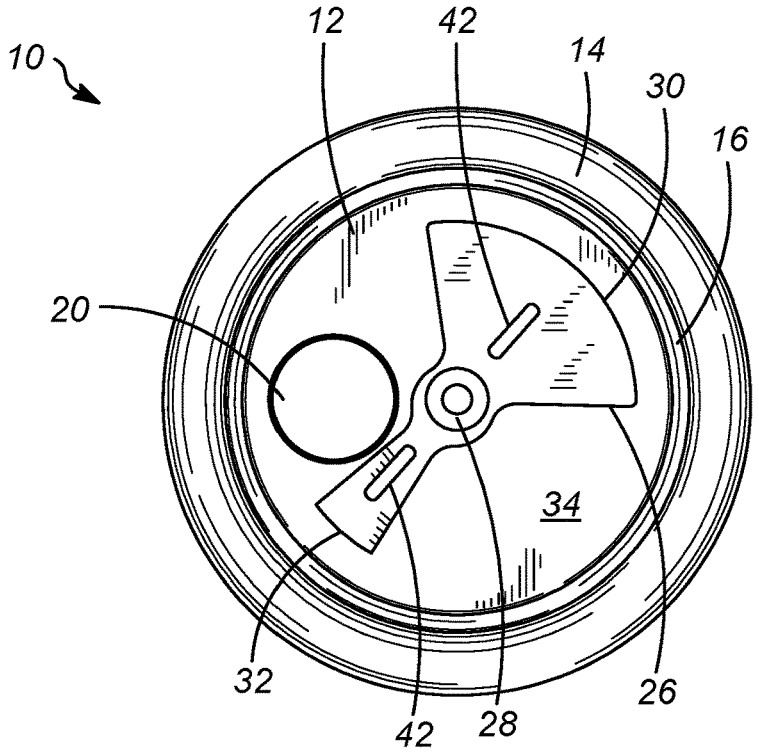
Figure 11D:
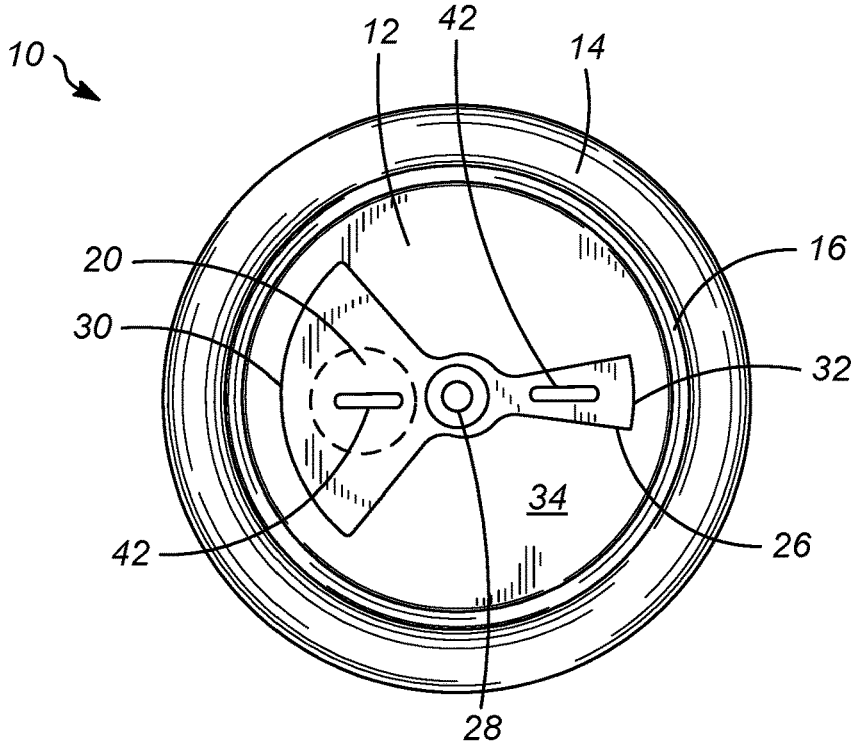
Figure 12:
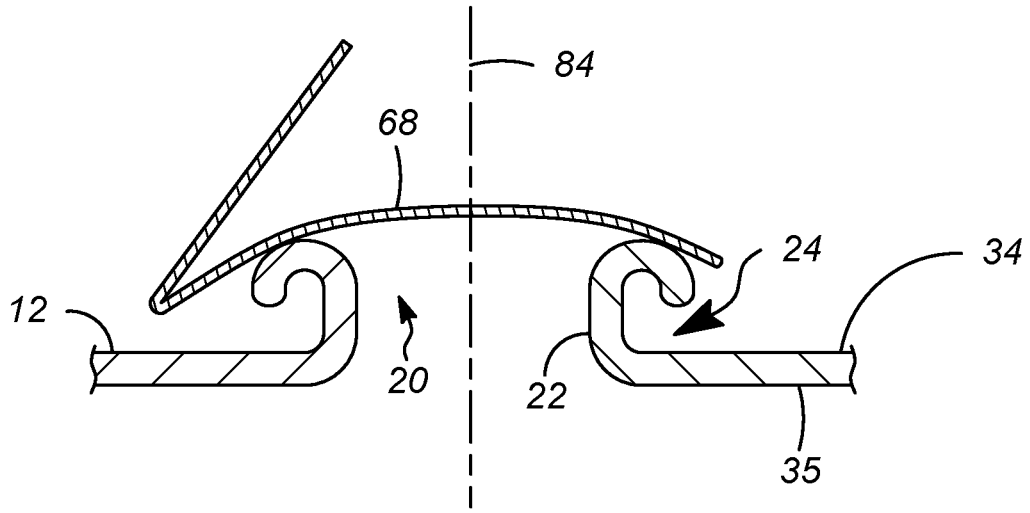
FIG. 12 is a magnified portion of a sealed pour opening of a cross-sectional view taken through XII-XII of FIG. 11B.
Figure 13:
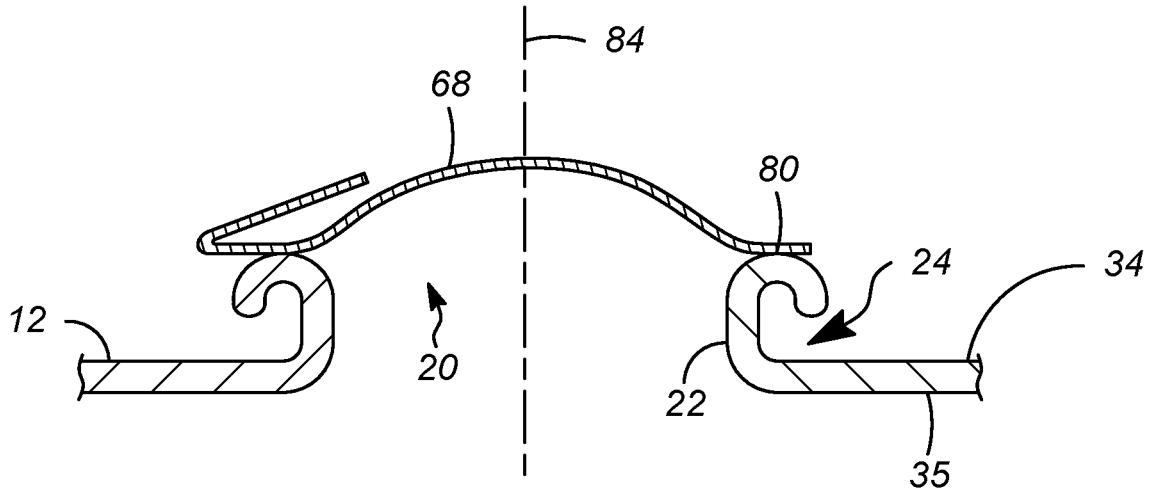
FIG. 13 is an alternative arrangement of that shown in FIG. 12 showing a sealed pour opening.
Figure 14:
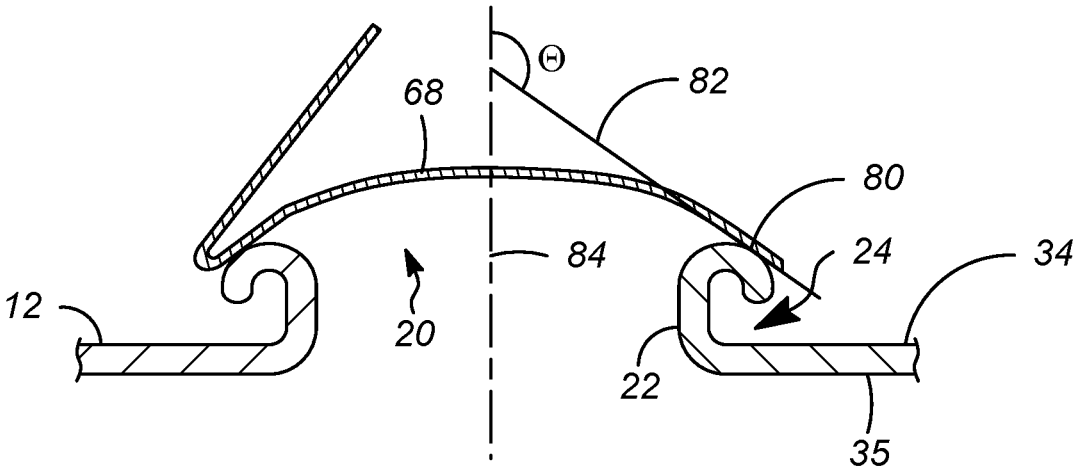
FIG. 14 is an alternative arrangement of that shown in FIG. 12 showing a sealed pour opening.
Figure 15:
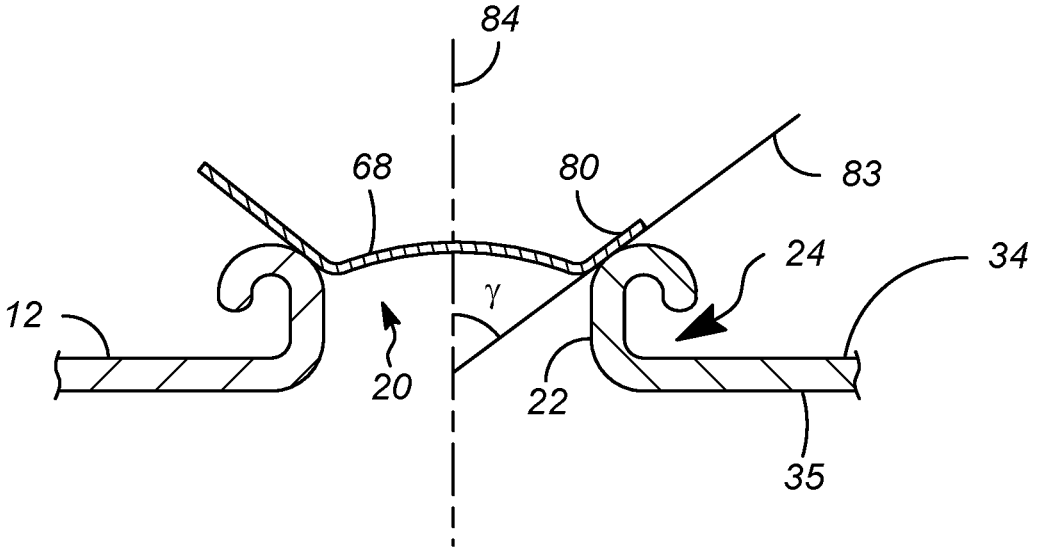
FIG. 15 is an alternative arrangement of that shown in FIG. 12 showing a sealed pour opening.

Referring to FIGS. 10A and 10B, an additional structure may be provided on one or more of the pour opening curl 22 and the tab curl 52 to achieve a better, tighter reclosing, prevent accidental over-rotation of the tab 26 along the center panel 12 from the second position back to the first position over the pour opening 20, and/or more securely lock the tab 26 over the pour opening 20. For example, the pour opening and tab curls 22,52 may include an angle to draw the pour opening curl 22 and tab curl 52 together and compress the layer(s) of sealing material(s) 56,58 therebetween. One or more detents 60 may be formed in the pour opening and/or tab curls 22,52. As shown in FIGS. 10A and 10B, the detents 60 cooperate to lock the tab 26 to the center panel 12 and about the pour opening 20. More specifically, as the tab 26 is rotated along the public side 34 of the center panel 12, a detent 60 on the tab curl 52 receives a corresponding convex portion 64 on the pour opening curl 22. Further, detents 60 on the pour opening curl 22, which are located on opposite sides of the convex portion 64 receive corresponding convex portions 64 formed from the tab curl 52 and located on opposite sides of the tab curl 52 detent 60.

An alternative embodiment is illustrated in FIGS. 11A-D. Here, the pour opening 20 is initially sealed by a separate removable pour opening closure member 68. This pour opening closure member 68, such as a flexible metal foil closure, has a sealing portion 72 extending over the pour opening 20 and peelably bonded by, for example, one or more layers of a sealing material 56 located between the closure member 68 and the center panel 12, for example any of the options discussed above forming a seal with a portion of the center panel 12 surrounding the pour opening 20. The closure member 68 further includes a lift end 76 which may be grasped by a user to lift and remove the closure member 68 from the center panel 12.

The closure member 68 may be produced from a laminate, for example a sheet material comprising metal foil, such as aluminum foil, preferably a suitably lacquered aluminum foil sheet or an aluminum foil-polymer laminate sheet. Stated more broadly, materials that may be used for the closure member 68 include, without limitation, lacquer coated foil (where the lacquer is a suitable heat seal formulation); extrusion coated foil (where the polymer is applied by a standard or other extrusion coating process); the aforementioned foil-polymer laminate, wherein the foil is laminated to a polymer film using an adhesive tie layer; and foil-paper-lacquer combinations such as have been used for some low-cost packaging applications.

The closure member stock may be a suitable deformable material such as an aluminum foil (e.g. made of alloy AA3104 or of a conventional foil alloy such as AA3003, 8011, 8111, 1100, 1200) with a thickness of 0.002 ins. to 0.004 ins. (50.8 μm to 101.6 μm) which is either lacquered on one side with a suitable heat sealable lacquer, or laminated on one side with a suitable heat sealable polymer film (e.g., polyethylene, polypropylene, etc.), 0.001 ins. to 0.002 ins. (25.4 μm to 50.8 μm) thick. The public side 34 should have a suitable protective lacquer coating. It may be desirable to print onto the foil using known printing methods. It may also be desirable to emboss the laminate to make the closure easier to grip.

The closure member 68 and heat seal must be designed to withstand the force provided by the pressurized contents of a container. Therefore, the closure member 120 must be bonded to withstand tear/shear force resistance that range from 25 lb/in (0.45 kg/mm) to 75 lb/in. (1.34 kg/mm), or any range or combination of ranges therein.

When applied to the can end 10, the portion of the closure member 68 that extends across the pour opening 20 may be substantially planar. When the can end 10 is mounted on a container that is filled with a carbonated beverage, the pressure given off by the carbonation causes closure member 68 to bulge upwardly.

This embodiment includes a rotational tab 26 which can be used to reseal the pour opening 20 when desired.

The embodiment of FIGS. 11A-D allows the manufacturer to make a can end 10 with either a pour opening curl 22 or no pour opening curl at all. Subsequently, outside the conversion press, the closure member 68 can be oriented and attached to the public side 34 of the center panel 12 and about the pour opening 20 to form a peelable seal which can be removed entirely, if desired, to unseal the pour opening 20. The rotational tab 26 can then be provided to reseal the contents of the container within the container vessel.

The tab 26 can be rotated or positioned over the closure member 68 after the closure member 68 is applied to the pour opening 20. This would help prevent tampering and be helpful in preventing transport damage. A container opening sequence for user would be as follows: 1) rotate tab to expose the closure member 68; 2) peel the closure member 68 from the can end 10; and 3) rotate the tab 26 to reseal the pour opening 20 as desired.

In another embodiment, the closure member 68 can be attached to the tab 26 or can end 10 center panel 12 such that the closure member 68 cannot be removed easily. This would prevent litter from the closure member 68 and prevent possible hazards.

As illustrated in FIGS. 12-15, the closure member 68 can be applied to a pour opening curl 22. This arrangement can be used in combination with the previously described embodiments featuring one or more sealing materials 56,58. To provide enhance a sufficient seal between the closure member 68 and the pour opening curl 22, a feature can be formed on the pour opening curl 22, such as a flattened portion 80 of the pour opening curl 22. This flattened portion 80 is generally circumferential, and its position on the pour opening curl 22 can further enhance the seal. For example, the flattened portion 80 can be positioned on a top of the pour opening curl 22, such that the flattened portion 80 is within about ±5 degrees of horizontal (see FIG. 13), the flattened portion 80 can be positioned radially outwardly in relation to the pour opening 20 such a line 82 drawn parallel to the flattened portion 80 forms an obtuse angle $_\theta$ with a central vertical axis 84 of the pour opening 20 when viewed from the public side 34 of the can end 10 (see FIG. 14), or the flattened portion 80 can be positioned radially inwardly in relation to the pour opening 20 such a line 83 drawn parallel to the flattened potion 80 forms an acute angle ν with a central vertical axis 84 of the pour opening 20 when viewed from the public side 34 of the can end 10 (see FIG. 15).

Figure 16:
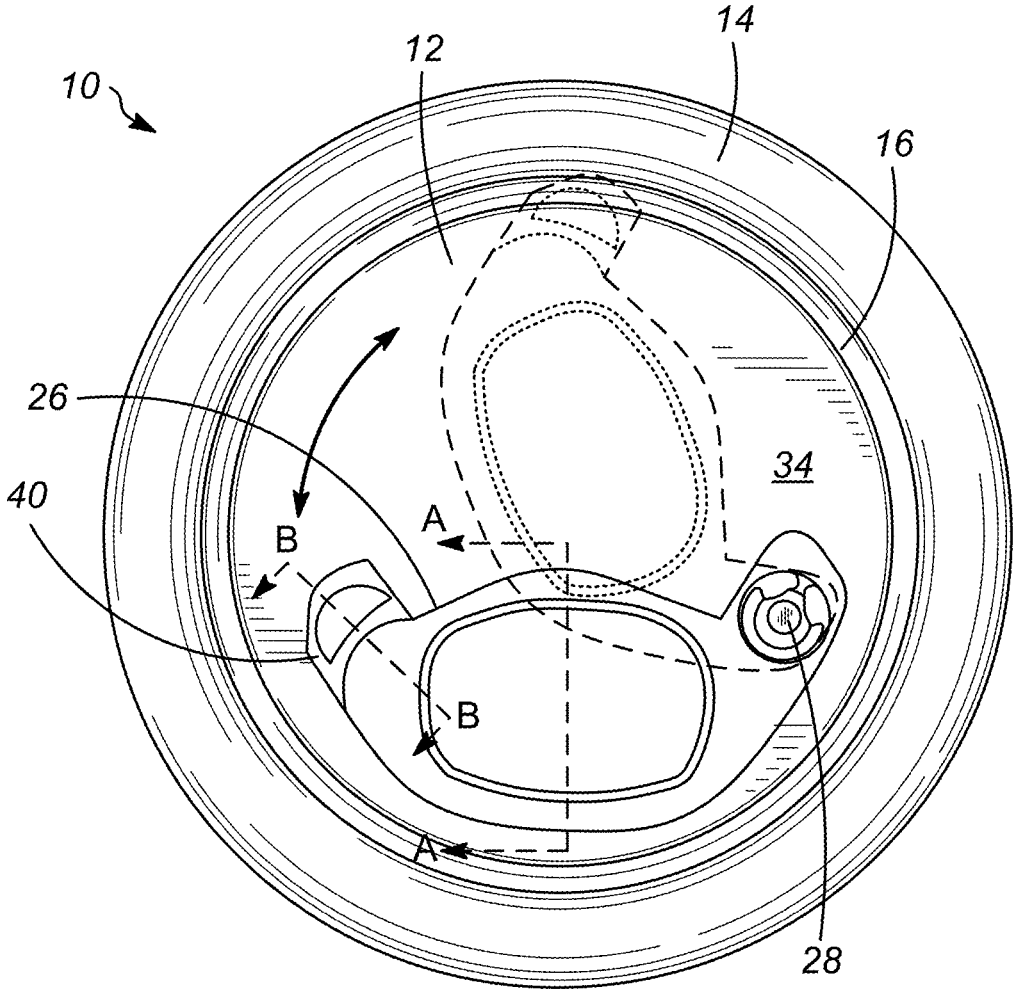
FIG. 16 is a top view of an alternative embodiment of the present invention having a rotatable tab for reclosing the pour opening.

Referring to FIG. 16, the tab 26 can be retained to the center panel 12 by a rivet 28 that is offset from the longitudinal axis 50. The arrow on FIG. 16 shows the tab is rotatable about an axis passing through the rivet 28. This configuration allows for a wider pour opening 20. In this embodiment, the can end 10 is opened by pulling the tab 26 upwardly from the public side 34 of the can end 10 to break a seal and by rotating the tab 26 about the rivet 28.

Figure 17A:
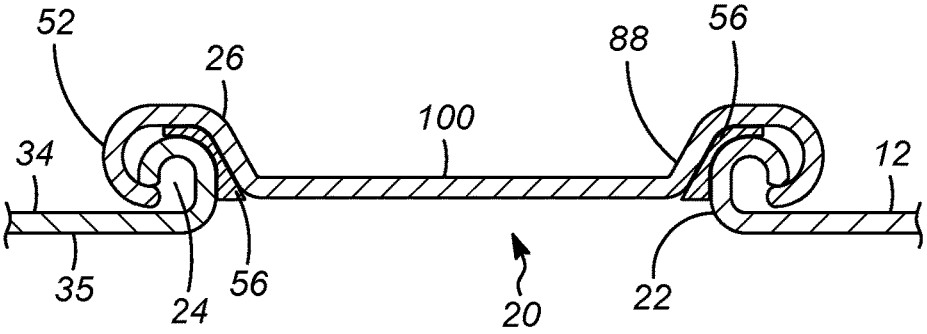
FIG. 17A is a partial cross-sectional view taken along A-A of FIG. 16 showing a possible configuration of the tab over the pour opening.
Figure 17B:
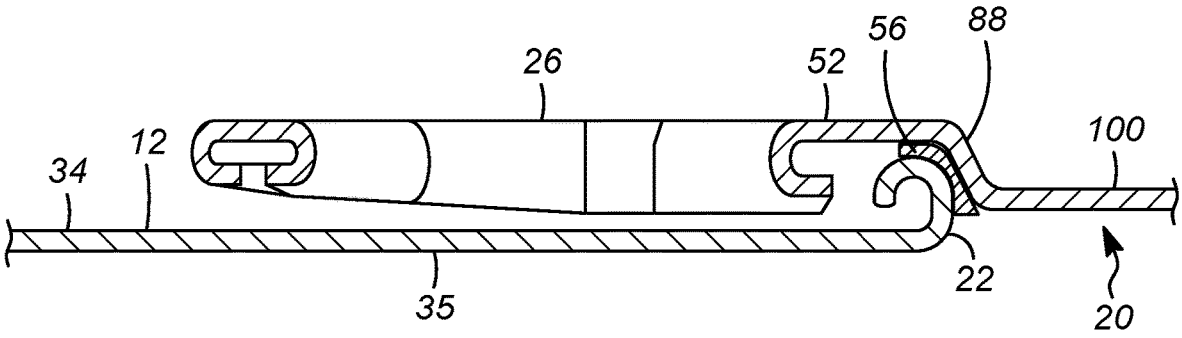
FIG. 17B is a partial cross-sectional view taken along B-B of FIG. 16 showing a possible configuration of the tab over the pour opening.
Figure 18A:
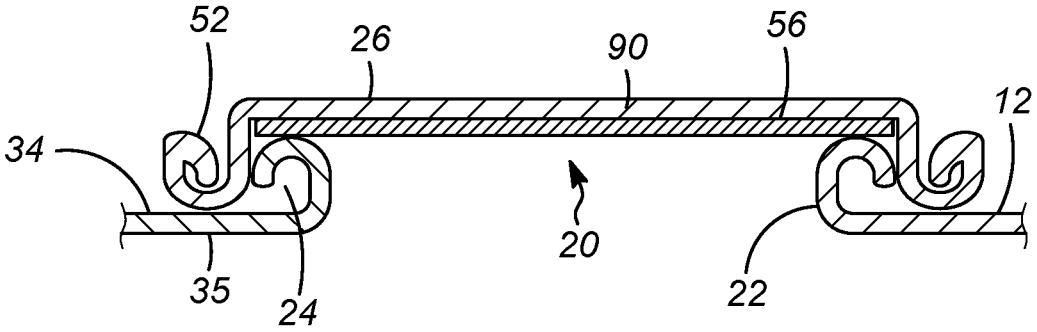
FIG. 18A is a partial cross-sectional view taken along A-A of FIG. 16 showing a possible configuration of the tab over the pour opening.
Figure 18B:
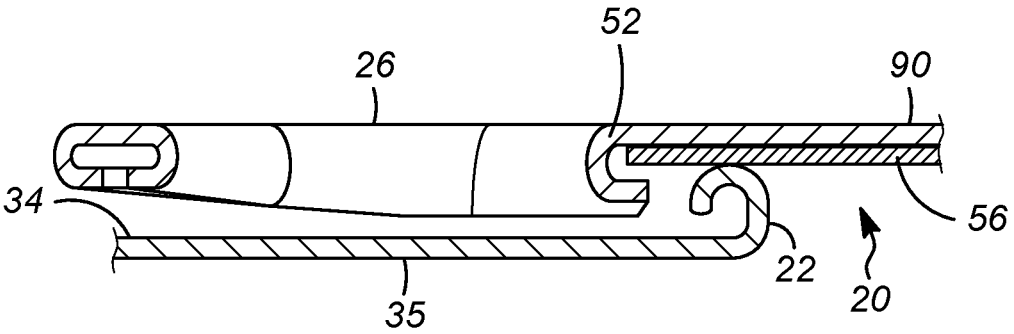
FIG. 18B is a partial cross-sectional view taken along B-B of FIG. 16 showing a possible configuration of the tab over the pour opening.

As shown in FIGS. 17A,B and 18A,B, tab curls 52 may or may not engage pour opening curls 22 to aid in retaining the tab 26 in the pour opening reclosed position. The tab 26 can have a concave portion 100 that extends into the pour opening. In FIGS. 17A,B, the tab 26 features a plug portion 88 that can be positioned within the pour opening 20 to thwart fluid leakage. When viewed from the public side 34 of the can end 10, the plug portion 88 is a concave recess. In FIGS. 18A,B, the tab 26 has a substantially planar portion 90 configured to be placed over the pour opening 20. The inventors contemplate that the tabs 26 of this embodiment can be provided with any of the embodiments described above, including but not limited to the closure members, curl geometries, and sealing materials 56,58 set forth above. The sealing material 56,58 may be applied to a circumferential wall of the plug 88 that fits within the pour opening as illustrated and may have a frustoconical shape/orientation (see FIGS. 17A and 17B). Additionally, the center panel 12 of this embodiment may include the retainer 104 as described below and illustrated in FIG. 23.

Figure 19:
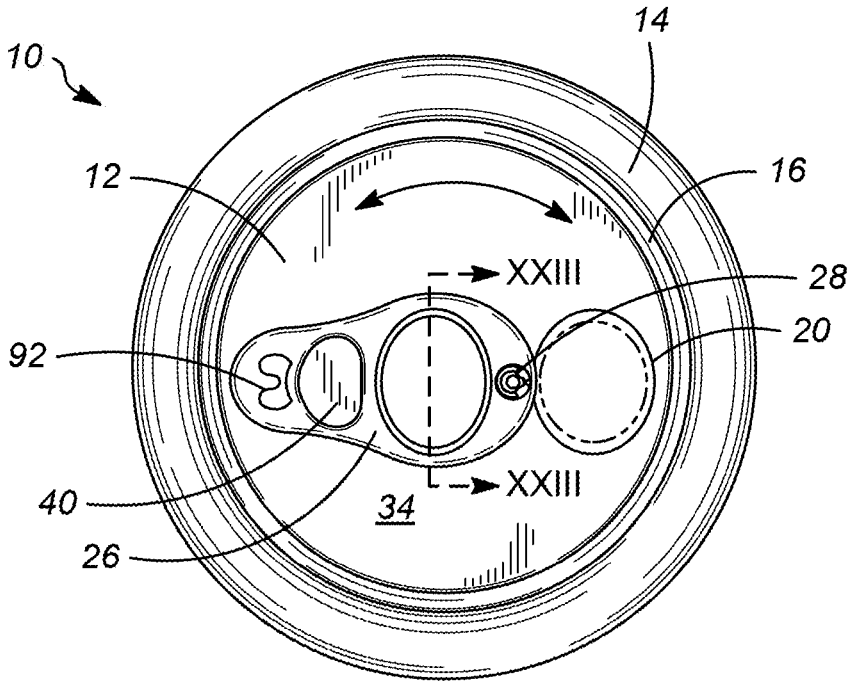
FIG. 19 is a top view of an alternative embodiment of the present invention having a rotatable tab for reclosing the pour opening and a keeper for maintaining the tab over the pour opening in a first position.
Figure 20:
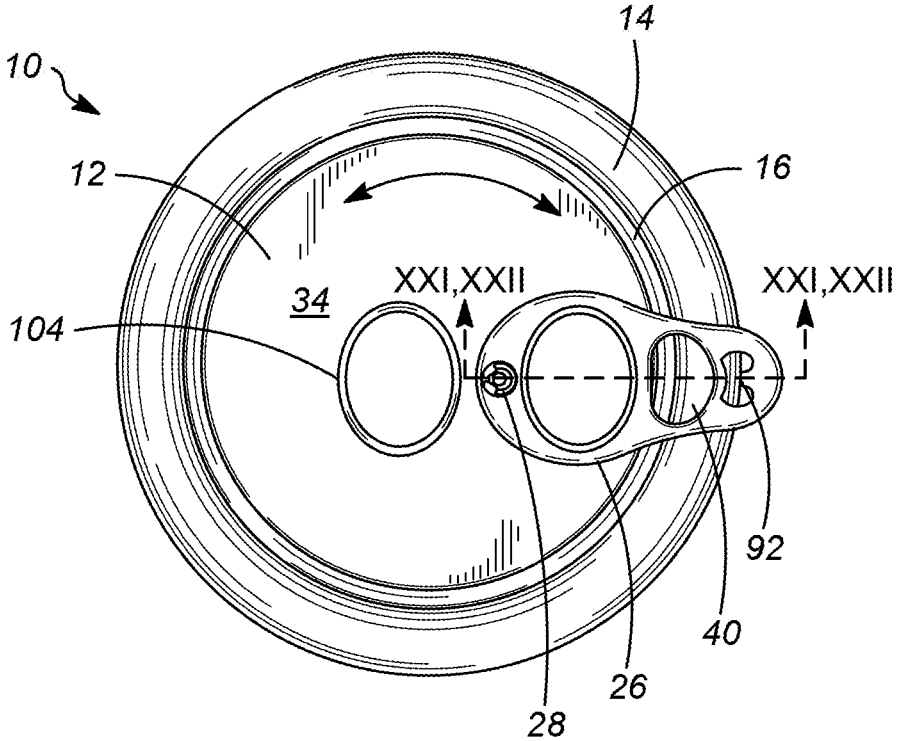
FIG. 20 is a top view of an alternative embodiment of the present invention having a rotatable tab for reclosing the pour opening and a keeper for maintaining the tab over the pour opening in a second position reclosing the pour opening.

Referring to FIGS. 19 and 20, an alternative can end 10 having a rotatable tab 26 is illustrated. According to this embodiment, the rivet 28 is offset from the longitudinal axis 50. The tab 26 can be rotated to place it over the pour opening 20 to reclose the pour opening 20. The lift end 32 of the tab 26 features a keeper 92. When in the tab 26 is in the reclosed position illustrated in FIG. 20, the keeper 92 frictionally engages a portion of the curl 14 to retain the tab 26 in the desired position and reduce or eliminate fluid leakage. This contact between the keeper 92 and the curl 14 formed into a double seam 96 attaching the can end to a can body (not shown) is also illustrated, for example in FIGS. 21 and 22. In this embodiment, the can end 10 is opened by pulling the tab 26 upwardly from the public side 34 of the can end 10 to break a seal and by rotating the tab 26 about the rivet 28.

Figure 21:
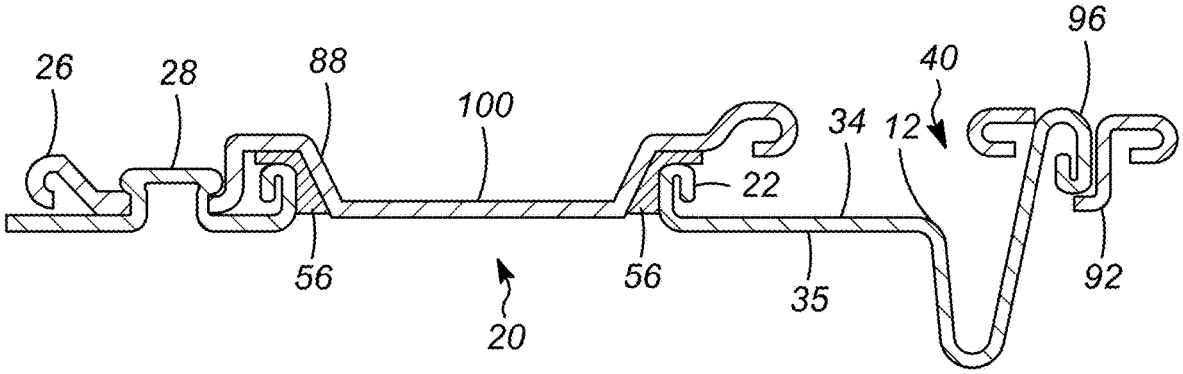
FIG. 21 is a partial cross-sectional view taken through XXI,XXII-XXI,XXII of FIG. 20 of an embodiment substantially similar to that of FIGS. 19 and 20 showing a possible configuration of the tab over the pour opening.
Figure 22:
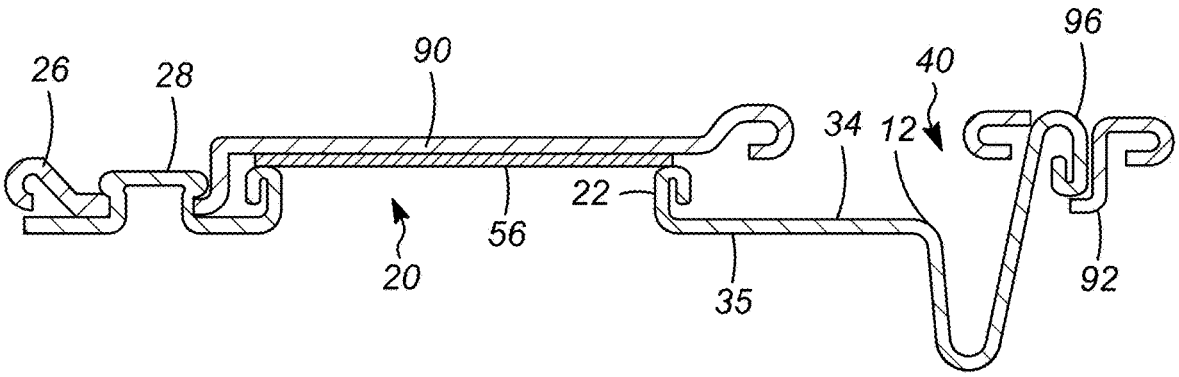
FIG. 22 is a partial cross-sectional view taken through XXI,XXII-XXI,XXII of FIG. 20 of an embodiment substantially similar to that of FIGS. 19 and 20 showing a possible configuration of the tab over the pour opening.

In FIG. 21, the tab 26 features a plug portion 88 that can be positioned within the pour opening 20 to thwart fluid leakage. When viewed from the public side 34 of the can end 10, the plug portion 88 is a concave recess. In FIG. 22, the tab 26 has a substantially planar portion 90 configured to be placed over the pour opening 20. The inventors contemplate that the tabs 26 of this embodiment can be provided with any of the embodiments described above, including but not limited to the closure members, curl geometries, and sealing materials 56,58 set forth above. The sealing material 56 may be applied to a circumferential wall of the plug 88 that fits within the pour opening as illustrated and may have a frustoconical shape/orientation (see FIG. 21)

Figure 23:
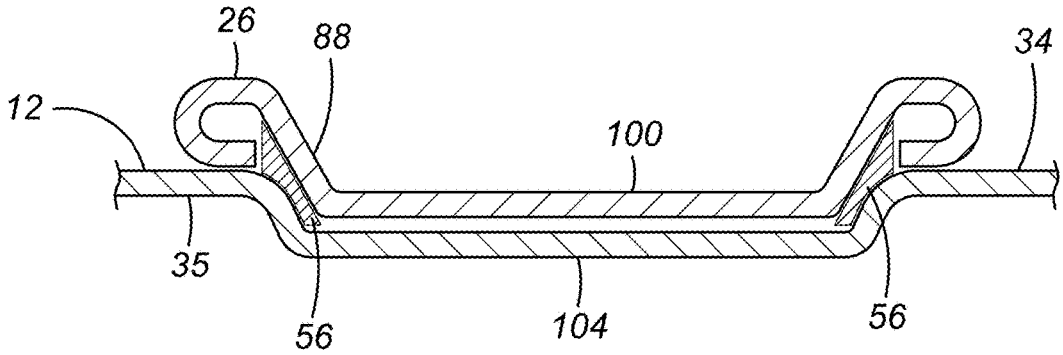
FIG. 23 is a partial cross-sectional view taken through XXIII-XXIII of FIG. 19 showing a plug portion retained in a position on the center panel of the can end by a retainer in the form of a recess formed in a public side of the can end.

As illustrated in FIG. 23, the center panel 12 may include a retainer 104 configured to retain the plug portion 88 in a desired position or location above the center panel 12 when the can end is in an open condition and the pour opening 20 is not blocked by the plug portion 88. In FIG. 23 the retainer 104 is a recess forming a concave surface on the public side 34 of the can end 10. The recess is sized and shaped accordingly to accept the concave portion 100 of the plug portion 88 therein. This retainer 104 may be included on any embodiment, but is preferably included on embodiments that feature a plug portion 88 or other recess on the tab 26 that fits within the pour opening 20 in the reclosed condition of the can end 10.

The inventors contemplate that the present disclosure can be applied to non-beverage containers as well, including but not limited to food containers, paint containers, lotion containers, etc. In other words, the invention described herein can be provided on any matter containing vessel in which a consumer might wish to reclose and/or reseal the contents thereof within.

While the specific embodiments have been illustrated and described, numerous modifications come to mind without significantly departing from the spirit of the invention, and the scope of protection is only limited by the scope of the accompanying Claims.

What is claimed is:

1. A reclosable beverage can end comprising:

a circumferential curl centered about a center longitudinal axis of the can end;

a circumferential wall extending downwardly from the curl and inwardly towards the longitudinal axis;

a center panel produced from a metallic material and centered about the longitudinal axis comprising a public side and an opposing product side;

a tab mounted to the public side of the center panel, the tab staked to the center panel by a rivet, wherein the rivet is formed from a material of the center panel and is integral therewith, wherein the tab is rotatable about the rivet; and a pour opening formed by an aperture in the center panel and sealed by the tab, the pour opening at least partially defined by a pour opening curl of the metallic material of the center panel, wherein the pour opening curl extends upwardly from the public side of the center panel, the pour opening curl forming a convex lip and a concave receiver between convex lip and the public side of the center panel, and the tab comprises a tab curl, which matingly engages the pour opening curl, the tab curl having a first tab curl portion extending downwardly and wrapping over the convex lip of the pour opening curl, the first tab curl portion having a first tab curl portion terminal end received within the concave receiver of the pour opening curl, the tab curl further having a second tab curl portion having a second tab curl portion terminal end that is spaced upwardly from the concave receiver of the pour opening.

2. The reclosable beverage can end of claim 1 wherein an epoxy is located between the tab and the center panel to form a seal therebetween over the pour opening.

3. The reclosable beverage can end of claim 2 wherein the seal is broken by rotating the tab on the center panel.

4. The reclosable beverage can end of claim 3 wherein the epoxy is chosen from a group consisting of a thermally cured epoxy and an ultraviolet cured epoxy.

5. The reclosable beverage can end of claim 4 wherein the epoxy is cured by at least one of an induction heating and an exposure to an ultraviolet light.

6. The reclosable beverage can end of claim 1 further comprising a thermoset polymer layer between the tab and the center panel forming a seal therebetween over the center panel.

7. The reclosable beverage can end of claim 6 wherein the seal is broken by rotating the tab on the center panel.

8. The reclosable beverage can end of claim 1 wherein the tab comprises a first tail extending outwardly from a surface of the tab and configured for engagement by a user's finger to rotate the tab.

9. The reclosable beverage can end of claim 8 wherein the first tail is located on a first end of the tab opposite a second end of the tab covering the pour opening.

10. The reclosable beverage can end of claim 8 wherein the first tail is located on an end of the tab wherein a portion of the tab covering the pour opening is also located on the end of the tab.

11. The reclosable beverage can end of claim 9 further comprising a second tail wherein the first tail is located on the first end of the tab opposite the second end of the tab covering the pour opening and wherein the second tail is located on the second end the tab.

12. The reclosable beverage can end of claim 1 wherein the tab comprises a finger hole.

13. The reclosable beverage can end of claim 12 wherein the finger hole is located on a first end of the tab opposite a second end of the tab covering the pour opening.

14. The reclosable beverage can end of claim 1 wherein the rivet is offset from the longitudinal axis, wherein the tab is rotational about an axis through the rivet extending parallel to the longitudinal axis.

15. The reclosable beverage can end of claim 14 wherein the tab comprises one of a plug configured to fit within the pour opening to reclose the can end and a planar portion wherein the plug forms a concave recess in the tab from a perspective of the public side of the center panel and the planar portion engages the pour opening curl to reclose the can end.

16. The reclosable beverage can end of claim 15 further comprising a sealing material to form a seal between the center panel and the plug or the planar portion to selectively seal the pour opening.

17. The reclosable beverage can end of claim 16 wherein the sealing material is applied to a circumferential wall of the plug that fits within the pour opening.

18. The reclosable beverage can end of claim 15 wherein the tab comprises a keeper configured to frictionally engage the circumferential curl to retain the tab in a desired position.

19. The reclosable beverage can end of claim 15 further comprising a retainer configured to retain the tab in a desired position above the public side of the center panel when the can end is in an open condition and the pour opening is not blocked by a portion of the tab.

20. The reclosable beverage can end of claim 19 wherein the retainer is a recess forming a concave surface on the public side of the center panel, and the recess is configured to receive the plug therein.

* * * * *